US005518198A

United States Patent [19]

Chumbley et al.

[11] Patent Number: 5,518,198

[45] Date of Patent: May 21, 1996

[54] WINDOW COVERING CORD STORAGE CONTAINER

[76] Inventors: James F. Chumbley, 11804 Marine View Dr., Edmonds, Wash. 98020; Ronald D. Stafford, 17431 Valley Circle Rd., Bothell, Wash. 98012

[21] Appl. No.: 334,408

[22] Filed: Nov. 4, 1994

[51] Int. Cl.[6] ..... B65H 75/38

[52] U.S. Cl. ..... 242/405.1; 242/588.2; 160/320

[58] Field of Search ..... 242/405.1, 405.2, 242/601, 141, 146, 400.1, 407, 588.2; 160/320, 178.1 R, 178.1 V, 345; 206/388, 495

[56] References Cited

U.S. PATENT DOCUMENTS

| | | | |
|---|---|---|---|
| 2,417,587 | 3/1947 | Damstra | 242/407 X |
| 2,565,339 | 8/1951 | Anderson | 242/601 X |
| 2,587,707 | 3/1952 | Dever | 242/407 X |
| 3,626,495 | 12/1971 | Bastian, Jr. | 242/407 X |
| 4,557,011 | 12/1985 | Sartori | 242/601 X |
| 4,909,298 | 3/1990 | Langhart et al. | 160/178.1 R |
| 5,125,447 | 6/1992 | Suggs | 160/320 X |
| 5,139,208 | 8/1992 | Schooley | 242/405.2 |

FOREIGN PATENT DOCUMENTS

| | | | |
|---|---|---|---|
| 2125370 | 3/1984 | United Kingdom | 242/405.2 |

*Primary Examiner*—Daniel P. Stodola
*Assistant Examiner*—William A. Rivera
*Attorney, Agent, or Firm*—Seed and Berry

[57] ABSTRACT

Safety cord reel for securing a window-shade cord or the like to prevent its entanglement with a small child. The safety cord reel has a storage reel that is secured to the window-shade cord and is used for receiving a varying amount of the window-shade cord by winding the amount of window-shade cord around the storage reel. The safety cord reel also has a retainer that prevents the window-shade cord from unwinding from the storage reel.

14 Claims, 3 Drawing Sheets

WINDOW COVERING CORD STORAGE CONTAINER

TECHNICAL FIELD

The present invention relates to a safety cord reel, and, more particularly to a reel for receiving and securing a varying length of window-shade cord or the like to prevent a small child from becoming entangled with the cord.

BACKGROUND OF THE INVENTION

Retractable window shades or the like are often actuated by pulling on a suspended length of cord to raise the shade. Typically the action of pulling on the cord and raising the shade results in an excess length of chord extending below the level of the end of the cord when the shade is lowered. This can result in the cord now being accessible to small children.

Since 1981, over 140 children have died by asphyxiation as a result of their accidental entanglement with a window-shade cord or the like. A majority of these entanglements were caused by the loops at the end of the window-shade cords. Usually, children, left unattended, would get caught by the neck in these loops and slowly suffocate. Even children as young as 8 months old have fallen victim to death by strangulation because window-shade cords were inadvertently left too close to their cribs.

This problem has become so serious, that the Consumer Product Safety Commission has made a significant effort to warn the population that all window-shade cords and chains should be kept permanently out of reach of children.

Accordingly, there is a need for a device that will allow a parent or other concerned adult to store any excess length of a window-shade cord so that it is out of the reach of a young child. The device must also prevent the stored length from unwinding, and be aesthetically pleasing enough so that the average person will consider using it within their homes.

SUMMARY OF THE INVENTION

According to the present invention, the risk of small children becoming entangled with a window-shade cord or the like, can be minimized by a safety cord reel having an H-shaped storage reel including two lateral structures and two transverse members wherein a varying amount of the window-shade cord is wound around the two transverse members and between the two lateral members. The safety cord reel also has an attachment member positioned between and coupled to the two lateral members of the H-shaped reel that secures the end of the windows-shade cord to the H-shaped reel. Further, the safety cord reel has fin members, each aligned with and protruding from a symmetric portion of each of the lateral members. The reel is prevented from unwinding by a housing including two opposing elliptical sides, two opposing flat sides each having a slot that is slidingly engageable with one of the fin members, and a top having an orifice through which the window-shade cord is passed. The housing also has tracks, each positioned on an inside surface of the flat sides of the housing and aligned with the slot in each of the flat sides, the tracks slidingly engaged with the two lateral members of the H-shaped reel to help prevent the H-shaped reel from twisting and unwinding.

DETAILED DESCRIPTION OF THE INVENTION

Figure 1A:
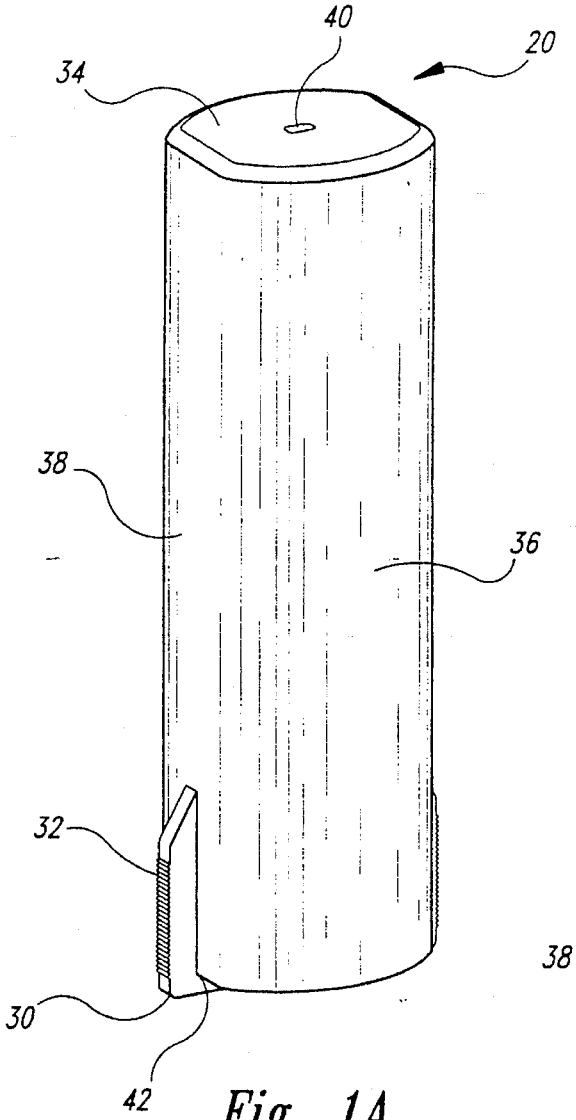
FIG. 1A is a perspective view of the safety cord reel having storage reel and sheath.
Figure 1B:
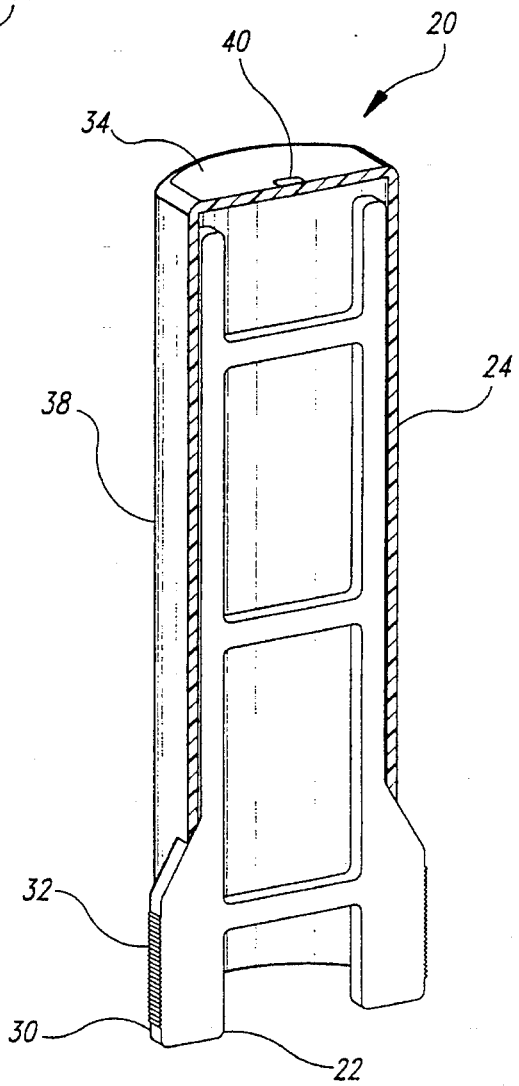
FIG. 1B is a perspective view with portions broken away showing how the storage reel fits into the sheath of the safety cord reel.

FIG. 1A shows a perspective view of the safety cord reel 20 of the present invention, and FIG. 1B shows the safety cord reel with parts broken away to show a cross-sectional view of the safety cord reel 20 when the storage reel 22 is located within the sheath 24. The safety cord reel 20 is attached to the end of a window-shade cord or the like (not shown) and any of the cord length that is in reach of a small child is stored on the storage reel 22 and held in place by the sheath 24.

The storage reel 22 includes a cord storage structure for receiving a varying amount of the window-shade cord by winding the amount of cord around the structure. In the preferred embodiment, the storage structure is H-shaped and has two spaced, lateral members 26 that are connected together, such as, by two separate transverse members 28.

The storage reel may include an attachment member 29 with an unobstructed area around the attachment member 29 which allows the end of the window-shade cord to be easily fastened to it. In a preferred embodiment, the attachment member 29 is located between the transverse members 28 and coupled to the two lateral members 26.

The material used in the cord storage structure is preferably acrylonitrile butadiene styrene resin (ABS). By using the two transverse members 28 and an attachment member 29 instead of a solid strip of ABS natural, the total amount of material used in the cord storage structure can be minimized without compromising the structural integrity of the storage reel 22.

Figure 2A:
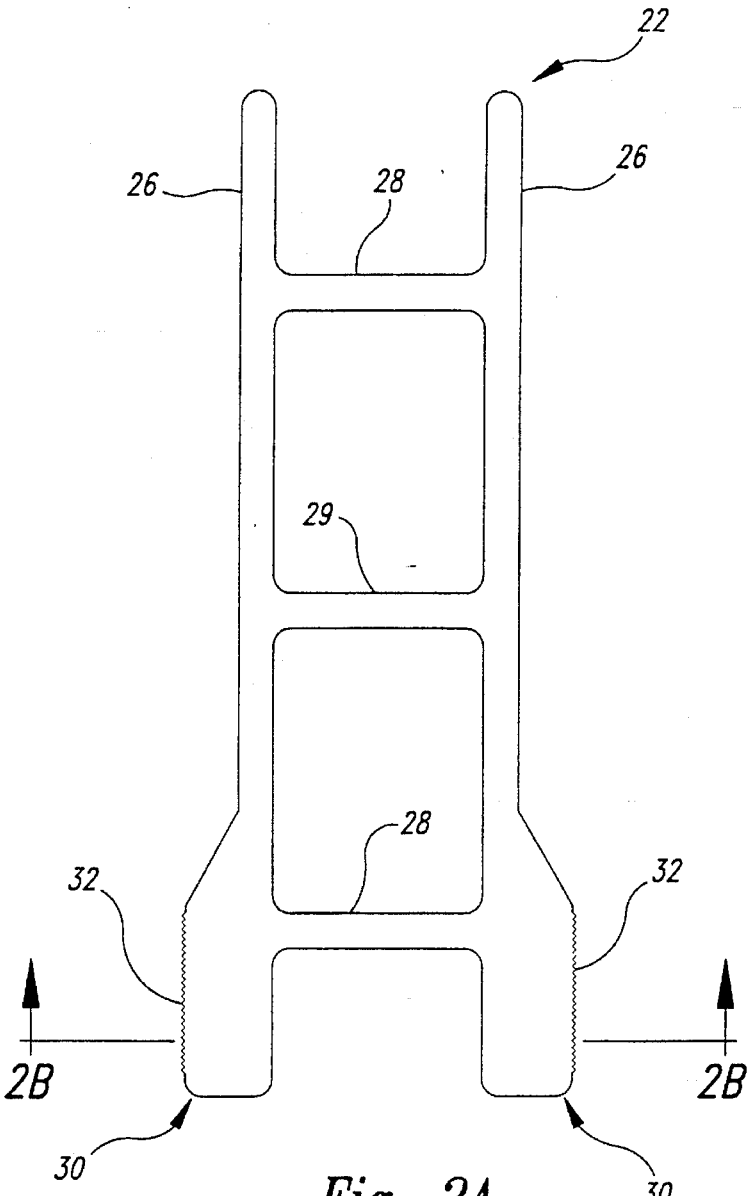
FIG. 2A is a front elevation view or the storage reel.
Figure 2B:
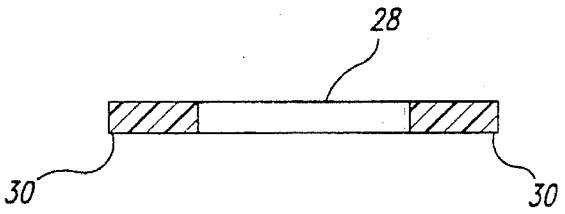
FIG. 2B is a cross-sectional view of the storage reel along the line 2B—2B of FIG. 2A.

Both the lateral members 26 have extend portions forming grips or fins 30 which are symmetrical and protrude outwardly from a lower portion of the lateral members 26, as shown in FIGS. 2A and 2B. The fins 30 are used to remove the storage reel 22 from the sheath 24, and have a serrated edge 32 to provide a better grip when separating the storage reel 22 from the sheath 24. The fins 30 can also be used as grips to hold on to when the window-shade cord is wrapped around the winding structure, i.e., the transverse members 28.

The sheath 24 in the preferred embodiment has a top 34, two elliptical sides 36, and two flat sides 38, as shown in FIGS. 1A, and 3A–3D. The top 34 has an orifice 40 through which the window-shade cord is drawn. The elliptical sides 36 have a radius of curvature that is based on the amount of window-shade cord potentially stored within the sheath 24. The elliptical sides also provide a more aesthetically pleasing housing, and may be grooved to provide a better grip when being used to pull down on the window-shade cord.

Figure 3A:
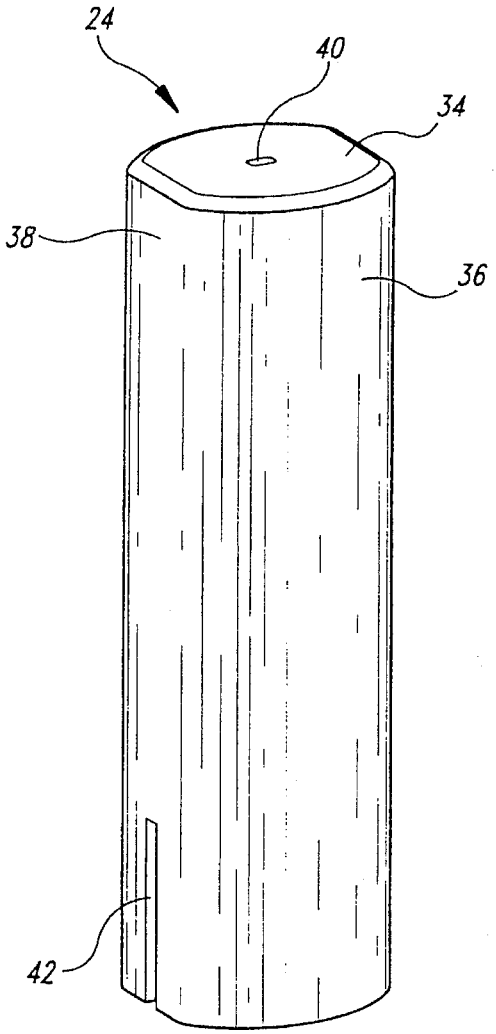
FIG. 3A is a perspective view of the sheath.
Figure 3B:
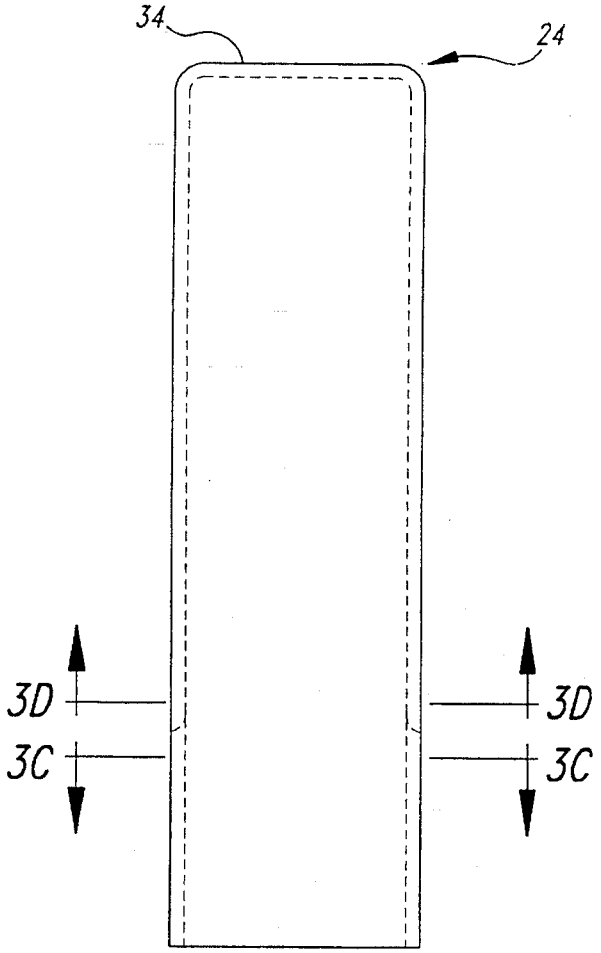
FIG. 3B is a front elevation view of the sheath.
Figure 3C:
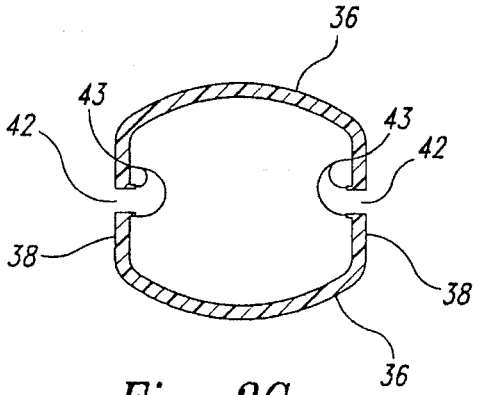
FIG. 3C is a cross-sectional view of the sheath along the line 3C—3C of FIG. 3B.
Figure 3D:
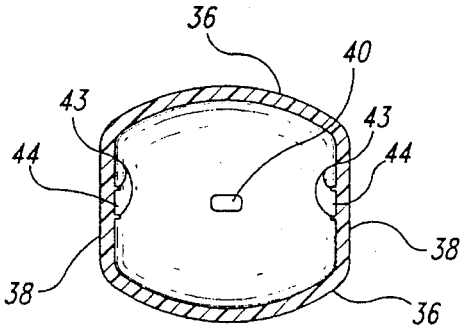
FIG. 3D is a cross-sectional view of the sheath along line 3D—3D of FIG. 3B.

The flat sides 38 of the sheath 24 have slots 42, as shown in FIG. 3A, into which the fins 30 slide when the storage reel 22 is inserted into the sheath 24 as shown in FIG. 1A. The slots 42 allow the fins 30 to extend out from the sheath 24, ensuring their easy accessibility. Further, the slots 42 hold the fins 30 in place, preventing the storage reel 22 frown rotating within the sheath 24. However, even the slots 42 and fins 30 do not prevent the lateral members 26 from twisting around within the sheath 24. To prevent this twisting action which creates additional stress on the storage reel 22, reducing its usable life and causing it to become difficult to remove from the sleeve 24, ridges 43 are embedded within the inside surface of the flat walls 38. These ridges 43 form channels or tracks 44. The tracks 44 are aligned with the slots 42 and guide the lateral members 26 along a straight path into the sheath 24 when inserted.

The safety cord reel works as follows. A window-shade cord, or a similar length of cord (not shown) which is used to control the covering of a window or an awning (not shown) is fed through the orifice 40 of the top 34 of the sheath 24. The end of the window-shade cord is then tied or otherwise fastened to the attachment member 29. A length of the window-shade cord is then wrapped around the transverse members 28 and retained by the extensions of the lateral members 26. The winding continues until the cord is no longer within the reach of small children. The stored cord is then prevented from unwinding from the reel by retention of the reel within the sheath 24. This is accomplished by lining tip the lateral members 28 and the fins 30 of the storage reel 22 with the tracks 44 and the slots 42 of the sheath 24, and proceeding to insert the storage reel 22 into the sheath 24. The friction between the storage reel 22 and the sheath 24, as well as the upward pull from the window-shade cord and the downward pull of gravity on the sheath 24 tends to prevent the storage reel 22 and the sheath 24 from separating, thus preventing the stored length of window-shade cord from unwinding.

When a window shade is closed, often the length of the window-shade cord is shortened. If this occurs, the sheath 24 and the storage reel 22 can be separated by pulling on the fins 30 with one hand and pushing on the sheath 24 with the other hand. Once these are separated, an extra length of the window-shade cord can be acquired by unwrapping the cord from the winding structure and then storing and securing the remainder as described above.

Accordingly, the present invention prevents small children from becoming entangled and possibly strangled by a window-shade cord by using a storage reel, secured to the window-shade cord, for receiving a varying amount of the window-shade cord around the storage reel, and a retainer to prevent the window-shade cord from becoming unwound from the reel.

While the detailed description above has been expressed in terms of a specific example, those skilled in the art will appreciate that many other structures could be used to accomplish the purpose of the disclosed procedure. Accordingly, it can be appreciated that various modifications of the abovedescribed embodiment may be made without departing from the spirit and scope of the invention. Therefore, the spirit and scope of the present invention are to be limited only by the following claims.

We claim:

1. A safety cord reel for securing a cord for a window-covering, said safety cord reel comprising:

a storage reel, which is secured to the window-covering cord, including a cord storage structure for receiving a varying amount of the window-covering cord by winding the amount of window-covering cord around said cord storage structure, said cord storage structure comprising two lateral members spaced a predetermined distance apart by two extensions wherein between said two lateral members the varying amount of the window-covering cord is wound, and wherein said storage reel further comprises fin members, each protruding from a respective one of said two lateral members; and a retainer which selectively engages the storage reel to prevent the window-covering cord from unwinding from said storage reel, said retainer comprising a housing including two slots into which said fin members slide.

2. The safety cord reel according to claim 1 wherein said retainer comprises a housing including two tracks positioned on an inside of said housing for guiding said two lateral members into said housing.

3. The safety cord reel according to claim 1 wherein said two extensions are perpendicular to said lateral members and extend away from said two lateral members to retain the wound cord.

4. The safety cord reel according to claim 1 wherein said storage reel comprises an attachment member positioned between said two lateral members and perpendicular to said two lateral members at said storage reel that is coupled to an end of the window-covering cord.

5. The safety cord reel according to claim 1 wherein said retainer comprises a housing including a top and four sides with the sides defining a bottom opening for receiving the storage reel.

6. The safety cord reel according to claim 5 wherein the top of the housing includes an orifice through which the window-shade cord may pass.

7. A safety cord reel for securing a cord for a window-covering, said safety cord reel comprising:

a storage reel which is secured to the window-covering cord, including a cord storage structure and two lateral members spaced a predetermined distance apart by two transverse members, wherein between said two lateral members a varying amount of window-covering cord is wound;

grips, each protruding from a respective one of the two lateral members of said storage reel; and a sheath encompassing said storage reel, said sheath including an orifice, through which the window-covering cord is passed, and slots through which said grips slide and through which the grips project.

8. The safety cord reel according to claim 7 wherein said storage reel further comprises an attachment member for securing said storage reel to the window-covering cord, said attachment member positioned between and coupled to the two lateral members.

9. The safety cord reel according to claim 7 wherein said sheath further comprises tracks to guide at least one of the two lateral members of said storage reel into said sheath, said tracks being positioned on the inside of said sheath.

10. The safety cord reel according to claim 9 wherein said tracks comprise two tracks, each aligned with the slots into which the grips slide.

11. The safety cord reel according to claim 7 wherein said sheath further comprises four sides and a top.

12. The safety cord reel according to claim 11 wherein the orifice is located in the top of said sheath.

13. The safety cord reel according to claim 12 wherein two of the four sides of said sheath have elliptical surfaces.

14. A safety cord reel for securing a cord for a window-covering, said safety cord reel comprising:

a cord storage reel including two lateral members and two transverse members connected therebetween intermediate to the ends of the lateral member so that a varying amount of the window-covering cord is wound around the two transverse members and between the two lateral members;

an attachment member positioned between the two transverse members and connected to the two lateral member of said storage reel and to which the end of the window-covering cord is secured;

fin members, each aligned with and protruding from a symmetric portion of each of the lateral members adjacent one end of the storage reel;

a housing including two opposing elliptical sides, two opposing flat sides each orifice through which the window-covering cord is passed; and tracks, each positioned on an inside surface of the flat sides of said housing and aligned with the slot in each of the flat sides, said tracks slidingly engageable with the two lateral members of said storage reel to securely retain the cord storage reel centrally within said housing.

* * * * *

UNITED STATES PATENT AND TRADEMARK OFFICE

CERTIFICATE OF CORRECTION

| | | |
|---|---|---|
| PATENT NO. | : | 5,518,198 |
| DATED | : | May 21, 1996 |
| INVENTOR(S) | : | James F. Chumbley et al. |

It is certified that error appears in the above identified patent and that said Letters Patent is hereby corrected as shown below:

In column 4, line 7 of claim 7, following "of", please insert --the--.

In column 5, line 5 of claim 14, please delete "member" and insert therefor --members--.

In column 5, lines 10 and 11 of claim 14, please delete "member" and insert therefor --members--.

In column 6, line 4 of claim 14, following "each", please insert --having a slot that is slidingly engageable with one of said fin members, and a top having an--.

Signed and Sealed this

Twenty-ninth Day of October 1996

*Attest:*

Bruce Lehman

BRUCE LEHMAN

*Attesting Officer*

*Commissioner of Patents and Trademarks*